US007934562B2

(12) United States Patent
Grimseth et al.

(10) Patent No.: US 7,934,562 B2
(45) Date of Patent: May 3, 2011

(54) HYBRID CONTROL SYSTEM AND METHOD

(75) Inventors: Tom Grimseth, Oslo (NO); Christian Borchgrevink, Langhus (NO)

(73) Assignee: Vetco Gray Scandinavia AS, Sandvika (NO)

( * ) Notice: Subject to any disclaimer, the term of this patent is extended or adjusted under 35 U.S.C. 154(b) by 956 days.

(21) Appl. No.: 11/792,253

(22) PCT Filed: Dec. 2, 2005

(86) PCT No.: PCT/IB2005/003659

§ 371 (c)(1),
(2), (4) Date: Jun. 4, 2007

(87) PCT Pub. No.: WO2006/059223

PCT Pub. Date: Jun. 8, 2006

(65) Prior Publication Data

US 2008/0257559 A1 Oct. 23, 2008

Related U.S. Application Data

(60) Provisional application No. 60/633,139, filed on Dec. 3, 2004.

(51) Int. Cl.
*E21B 29/12* (2006.01)

(52) U.S. Cl. ..... 166/368; 166/316; 166/351; 166/68.5; 166/105

(58) Field of Classification Search ..... 166/335, 166/336, 351, 316, 368, 363, 364, 373, 68, 166/68.5, 105

See application file for complete search history.

(56) References Cited

U.S. PATENT DOCUMENTS

| | | | | | |
|---|---|---|---|---|---|
| 3,219,118 | A | * | 11/1965 | Lewis | 166/351 |
| 3,353,594 | A | * | 11/1967 | Lewis | 166/336 |
| 3,516,491 | A | * | 6/1970 | Lewis | 166/336 |
| 3,894,560 | A | * | 7/1975 | Baugh | 137/606 |
| 4,052,703 | A | * | 10/1977 | Collins et al. | 714/2 |
| 4,112,687 | A | * | 9/1978 | Dixon | 60/641.6 |
| 4,265,313 | A | * | 5/1981 | Arnaudeau | 166/366 |
| 4,328,826 | A | * | 5/1982 | Baugh | 137/236.1 |

(Continued)

FOREIGN PATENT DOCUMENTS

GB 2266546 A 11/1993

(Continued)

OTHER PUBLICATIONS

PCT/ISA/210—International Search Report—May 22, 2006.

(Continued)

*Primary Examiner* — Thomas A Beach

(74) *Attorney, Agent, or Firm* — Venable LLP; Eric J. Franklin

(57) ABSTRACT

A hybrid process control system including electrical transmission of power to a sub-sea hydraulic power unit, which in turn provides hydraulic power for control of hydraulic actuators. A circulation system using small bore tubing in the umbilical cord in combination with a traditional topside hydraulic power unit provides for active control of hydraulic fluid quality with respect to contamination caused by the sub-sea hydraulic actuators, especially process gas from down hole safety valves. Thus, a more economical power transmission is achieved without reduction of fluid quality, which is essential to system integrity and reliability. Also, a significant enhancement of power transmission without a dramatic increase in the size of hydraulic supply and return lines is achieved. Fluid environmental issues are reduced to a negligible aspect.

15 Claims, 4 Drawing Sheets

U.S. PATENT DOCUMENTS

| | | | | |
|---|---|---|---|---|
| 4,378,848 | A * | 4/1983 | Milberger | 166/351 |
| 4,506,735 | A * | 3/1985 | Chaudot | 166/357 |
| 4,607,701 | A * | 8/1986 | Gundersen | 166/368 |
| 4,848,472 | A * | 7/1989 | Hopper | 166/344 |
| 5,587,707 | A * | 12/1996 | Dickie et al. | 340/870.09 |
| 6,059,539 | A * | 5/2000 | Nyilas et al. | 417/228 |
| 6,484,806 | B2 * | 11/2002 | Childers et al. | 166/351 |
| 6,564,872 | B2 * | 5/2003 | Davey et al. | 166/344 |
| 7,044,156 | B2 * | 5/2006 | Webster | 137/488 |
| 7,137,450 | B2 * | 11/2006 | Johansen et al. | 166/316 |
| 7,159,662 | B2 * | 1/2007 | Johansen et al. | 166/374 |
| 7,287,595 | B2 * | 10/2007 | Johansen et al. | 166/321 |
| 7,398,830 | B2 * | 7/2008 | Johansen et al. | 166/321 |
| 7,650,942 | B2 * | 1/2010 | Abbey et al. | 166/338 |
| 2002/0040786 | A1 | 4/2002 | Davey et al. | |
| 2003/0103811 | A1 * | 6/2003 | Grimseth | 405/157 |

FOREIGN PATENT DOCUMENTS

| | | | |
|---|---|---|---|
| WO | WO 91/16523 | * | 10/1991 |
| WO | WO-91/16523 | A1 | 10/1991 |
| WO | WO-00/01915 | A2 | 1/2000 |
| WO | WO-2006/059223 | A3 | 6/2006 |

OTHER PUBLICATIONS

PCT/ISA/237—Written Opinion of the International Searching Authority—May 22, 2006.

* cited by examiner

HYBRID CONTROL SYSTEM AND METHOD

CROSS-REFERENCE TO RELATED APPLICATIONS

This application claims priority to U.S. provisional patent application 60/633,139 filed 3 Dec. 2004 and is the national phase under 35 U.S.C. §371 of PCT/IB2005/003659 filed 2 Dec. 2005.

TECHNICAL FIELD OF INVENTION

The present invention relates to an electro-hydraulic process control system in sub-sea production installations for well fluids, including oil or gas production and injection of gas or water. The invention also refers to a method for operating the process control means of the electro-hydraulic process control system.

The expression "process control" as used in this application should be understood to include production control such as performed by Christmas tree actuators and down hole safety valves, as well as control of process equipment such as separators and pressure boost equipment. It is common practice in sub-sea engineering to integrate emergency shut down systems and production control systems. Thus, "process control" is considered to encompass some or all of these and other relevant types of control or process management in this application.

BACKGROUND OF THE INVENTION AND PRIOR ART

The remote control of sub-sea valve actuators for Christmas Trees (XTs) and manifold systems have evolved from simple concepts in the seventies to extensive and complex electro-hydraulic systems with offset distance capacity currently passing the 160 km limit. Traditionally hydraulic control power is generated at a host facility, based on a floating or semi-submerged unit or land based, and transmitted to the sub-sea facility at two different pressures: typically at 207 bars for the XT actuators, and pressures up to (and exceeding) 700 bars for the down hole safety valves (DHSV). Sub-sea hydraulic power units (HPU) located at the sub-sea production facility has been considered many times, but only a few and relatively insignificant installations of this type were ever made.

Process control systems are characterized by infrequent actuation and corresponding low average hydraulic power consumption, thus by means of accumulators located at the sub-sea facility it has been possible to use small bore tubing (typically ⅜" to ¾" tubing size) for the hydraulic power transmission. It has only exceptionally and infrequently been considered beneficial to deviate from this design practice as even a minor loss in reliability of the control system can be of great significance to cash flow and intervention efforts.

For most sub-sea process control systems, internal leakage from directional control valves (DCV) has been the dominant source of fluid consumption while actuation of the valves often accounts for less than 15% of the total fluid consumption.

Two courses of development initiates a revision of the current design practice:

Offsets up to 600 km are seriously considered for sub-sea tieback to the beach, essentially for transfer of dry gas products;

New processing facilities, especially fast acting process control valves, require high power levels on a near continuous basis.

Sub-sea hydraulic control valves are typically configured in one of two major categories, i.e. open loop and closed loop, the former based on dumping used fluid to sea and the latter based on returning the used fluid to the host HPU for re-use. Recent installations in environmentally sensitive areas have demonstrated the undesirable feature of open loop systems, since both corrosion inhibitor substances and dye additives are difficult to achieve in Green environmental (environment-friendly) class and tend to be offered in Yellow class, or even Red class.

Hydraulic control systems being part of the sub-sea production control use either water based fluids (mostly a mixture of distilled water and glycol plus additives) or mineral based/synthetic fluids. For extreme offset distances, the inherently low viscosity of the water based fluids and corresponding moderate transmission losses tend to dominate. Water based fluids can be used in both open loop systems and closed loop systems, whereas mineral oil can not be discharged to the environment.

In order to provide the required power for high flow or long offset scenarios, by means of an economically justifiable umbilical (and one that can be laid full length in a single campaign), the power transmission has to be electrical, otherwise umbilical content will grow out of all reasonable proportions.

Traditionally the following objections have been raised against the few sub-sea HPU and thus locally closed hydraulic loop concepts proposed:

1. Leakage of process gas from the production tubing will migrate into the hydraulic control line to the DHSVs and from there contaminate the entire hydraulic control system, any attempt at boosting a fluid contaminated with gas by means of a pump intended for single phase operation would be futile (compressibility and possibly eventually even free gas phase);
2. Leakage of minor quantities of fluid to the environment will eventually deplete the local HPU reservoir and constitute an operational problem;
3. Wet make/break electrical connectors are unreliable;
4. Electrical squirrel cage motors are unreliable as used in a sub-sea environment;
5. Fixed displacement pumps have limited operating time, typically maximum 12 000 hours under ideal conditions of clean fluid and good lubrication, and will require frequent interventions and thus loss of regularity in operation;
6. Rotor-dynamic pumps, e.g. centrifugal pumps, typically provide low pressure and high flow, the opposite of what is required for an HPU intended for production control purposes.

Thirty years of sub-sea oil and gas field developments and operations have basically demonstrated validity of these objections. However, recent developments have brought about many changes, the sum of which requires revision of the overall conclusion that sub-sea HPUs have no place in commercial sub-sea developments. With reference to the objections referred above the following changes have taken place:

1. DHSV actuators have improved considerably with respect to leakage. Nevertheless, leakage cannot be ignored as a factor, and the objection remains valid. A viable system requires system features to handle minor leakages of gas from the DHSVs;

2. A control system of absolutely no external leakage is unlikely, although environmentally significant leakages are rare. Replacement of lost fluid is required for high regularity operation;
3. Wet make/break connectors for 12 kV have been in operation for some time with good results and 36 kV systems have been qualified. High voltage (HV) wet make/break connectors have become a commercially viable component;
4. Electrical squirrel cage motors have been in operation for some time for 2 MW systems and 9-10 kV stator voltage. The motor issue is eliminated from the HPU discussion, which requires typically <15 kW of power for most applications;
5. Fixed displacement pumps for 2 MW power are being developed, but for less pressure than required for an HPU for control purposes;
6. Rotor-dynamic pumps for unprocessed well fluids (multiphase), produced water and even sea water, have been qualified for ratings up to 2 MW and operated for extended periods of time on fluids with significant particulate contamination.

Thus it may be fairly stated that with state-of-the-art components related to a sub-sea HPU the gas leakage and the pump unit remain as the only issues in relation to achievement of a reliable sub-sea HPU for control purposes.

All electric control systems have been proposed and developed for production control and are under development for XT actuators and fast acting Production control valves (PCVs). However, there are major objections to all-electric control systems that will most likely slow down their introduction into the market place:

1. An electro-hydraulic actuator design for fail close operation is relatively complex and reliability will be an issue;
2. There are few, if any, convincing design for a fail close actuator for the DHSVs;
3. In the event that horizontal XT design is pursued, the XT cannot be retrieved without prior retrieval of the tubing, a major workover operation of high cost, both in rig cost and deferred production, thus focusing even more on reliability.

SUMMARY OF THE INVENTION

The present invention thus has for an object to provide an electro-hydraulic process control system, in which supply of operating power and actuator response is secured at long offset distances between the sub-sea and host facilities of a sub-sea production installation.

Another object of the invention is to provide an electro-hydraulic process control system for a sub-sea production installation, in which hydraulic fluid quality is actively controlled at sub-sea level.

Yet another object of the invention is to provide an electro-hydraulic process control system, in which emergency shut down availability is enhanced and secured also at long offset distances between the sub-sea and host facilities of a sub-sea production installation.

Still another object of the invention is to provide an electro-hydraulic process control system in which the emergency shut down availability can be tested during continued operation of a sub-sea production installation.

A further object of the invention is to provide a control process, the steps of which are dedicated for securing operating power and actuator response at long offset distances between the sub-sea and host facilities of a sub-sea production installation.

These and other objects are met in an electro-hydraulic process control system and method.

Briefly, the present invention provides an electro-hydraulic process control system in a sub-sea production installation, comprising:

a top-side hydraulic power unit, driven and controlled to generate and supply hydraulic power to process control means of the sub-sea production installation at a steady-state operation mode;

a sub-sea hydraulic power unit, driven and controlled to generate and supply hydraulic power to the process control means at a transient-state operation mode;

an umbilical cord, comprising small bore tubing feeding hydraulic power from the top-side hydraulic power unit to the process control means, and cables feeding high voltage electric power for operation of the sub-sea hydraulic power unit, and means for controlling the sub-sea hydraulic power unit between a stand-by mode and an operative mode.

A significant feature of the invention is that the top-side hydraulic power unit is operable for providing the steady-state power represented by directional control valve leakage, and the sub-sea hydraulic power unit is operable for providing the transient-state power required to operate process and safety valves of the process control means.

To this purpose, the sub-sea hydraulic power unit comprises a pump driven by an electric motor powered by alternating current which is stepped down from the higher voltage supplied through the umbilical.

More specifically, the pump is operable and controlled in the transient-state operation mode to boost the pressure of hydraulic fluid returning from the process control means into a pressure required for operating the process and safety valves of the process control means.

In a preferred embodiment, hydraulic fluid is accumulated at operating pressure in a medium pressure accumulator bank, hydraulic fluid at return pressure is accumulated in a low pressure accumulator bank, and the pump being operable for charging the medium pressure accumulator bank with hydraulic fluid from the low pressure accumulator bank.

Advantageously, the process control system of the invention comprises a check valve through the operation of which hydraulic fluid supplied through the umbilical is returned through the umbilical to the top-side hydraulic power unit in a fluid circulation mode, at a pressure independent of the control system operating pressure.

Likewise preferred, the components of the sub-sea hydraulic power unit are contained in a pressure vessel from which hydraulic fluid in circulation mode is returned to the top-side hydraulic power unit by means of selectively operated directional control valves and via first and second return flow lines.

Thus, the first return flow line exits the pressure vessel from a bottom region thereof, extracting hydraulic fluid and particulate matter deposited in the pressure vessel, and the second return flow line exits the pressure vessel from a top region thereof, extracting hydraulic fluid and gaseous matter eventually accumulated in the pressure vessel.

In order to accelerate the hydraulic fluid extracted from the pressure-vessel's bottom and top regions, respectively, the first and second return flow lines advantageously connect to an eductor, which is powered by the hydraulic pressure supplied through the umbilical.

A redundant emergency shut down system is achieved according to the invention through providing at least two sets of directional control valves connected in series, each set including at least two directional control valves connecting in parallel the supply line and the return line, powering the directional control valves electrically through the umbilical and controlling the valves into a normally closed position.

In this way, the directional control valves of the emergency shut down system are controllable individually or in pairs into an open position, enabling operational test of all valves in the system without loss of production in the sub-sea production or processing installation.

Through the above-cited measures, the present invention also introduces a new method for operating the process control means in an electro-hydraulic process control system in a sub-sea production installation. The new method comprises the steps of:

- feeding hydraulic power, via an umbilical, from a top-side hydraulic power unit for operating the process control means in a steady-state operation mode of the process control system;
- feeding high voltage electric power, via the umbilical, for operating a sub-sea hydraulic power unit, and
- controlling the sub-sea hydraulic power unit between a stand-by mode and an operative mode for operating the process control means, in a transition operation mode of the process control system.

Preferably, the method further comprises the step of boosting, by said sub-sea hydraulic power unit, the pressure in hydraulic fluid returning from the process control means into a higher pressure required for operating process and safety valves of the process control system.

Boosting the pressure of hydraulic fluid is achieved, according to the invention, by stepping down the high voltage electric power supplied via the umbilical, to a low voltage alternating current suitable for powering an electric motor and pump of the sub-sea hydraulic power unit.

The method advantageously also comprises the further step of separating, in a circulation mode, the flow of hydraulic fluid supplied via the umbilical from the flow of hydraulic fluid required to operate the process control means.

Likewise preferred, the method further comprises the step of extracting contaminants from the hydraulic fluid, at sub-sea level, in the circulation mode.

Quality control of hydraulic fluid may be achieved through the steps of depositing particulate contaminants at a bottom region of a pressure vessel and accumulating gaseous contaminants in a top region of said pressure vessel, and selectively extracting hydraulic fluid with particulate or gaseous contaminants from said pressure vessel.

The process of extracting contaminants may be further enhanced through the step of accelerating the return flow of hydraulic fluid by means of an eductor.

Testing the availability of the emergency shut down system, under continued production of the sub-sea production installation, is achievable through the provision of a redundant emergency shut down system by the introduction of multiple emergency shut down valves, electrically controlled into a normally closed position and individually operable into an open position for test purposes.

SHORT DESCRIPTION OF THE DRAWINGS

The invention is further explained below with reference made to the drawings, wherein FIG. 1 is a diagrammatic illustration of a set up of a sub-sea production installation;

DETAILED DESCRIPTION OF THE INVENTION

The invention is described in the following with reference to the drawings. Note that the drawings and the circuitry depicted are deliberately simplified, leaving out a number of details for clarity, e.g. electrical control and instrumentation, filters and auxiliary valves. Also some of the symbols used are simplified for the same reason. The simplifications do not, however, significantly impair the description of key, new features.

Figure 1:
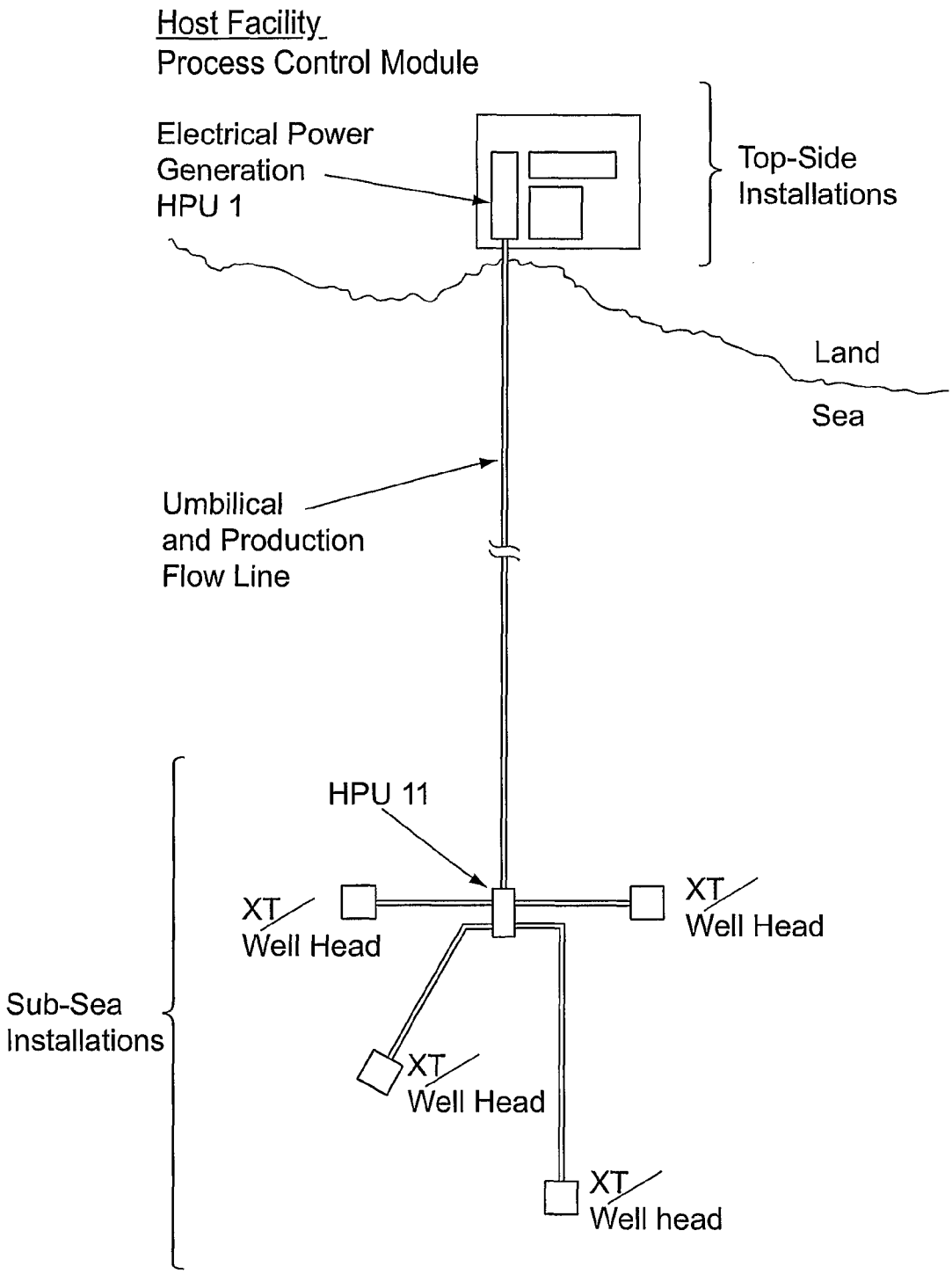

With reference to FIG. 1, a set up for production of well fluids may typically comprise a top-side installation communicating with one or more sea floor wells via production flow lines connecting the land-based facility to the well heads. Production is controlled through the Christmas tree (XT) structure, situated on the wellhead and controlled for administrating the flow of fluids from the well. Actuating and control power for production and safety valves incorporated in the XT-structure is supplied via a controls umbilical, connecting a process control module on the host facility to the XT. The process control system typically comprises electrical and hydraulic power units and control equipment, supplying control and actuating power to the sub-sea installations via pipes that are bundled into, and shielded by, the umbilical cord.

Naturally, for the purpose of this invention, the topside installations may be hosted on a land-based or a semi-submerged facility. Also naturally, in FIG. 1 the offset or tieback distance between the sub-sea installation and the host facility is grossly understated for illustrating purposes.

The invention features a system of circulation of hydraulic fluid to a remote, sub-sea HPU 11 and back to a topside HPU 1 on the host facility, such that any gas migrating from the DHSVs through the XT-tubing to the control module will be brought back to the sub-sea HPU and returned to the host facility HPU by means of the return line R in a closed system. Even small-bore lines (typically ½" for long offsets) in the umbilical have capacity to remove significant quantities of contamination.

Figure 2:
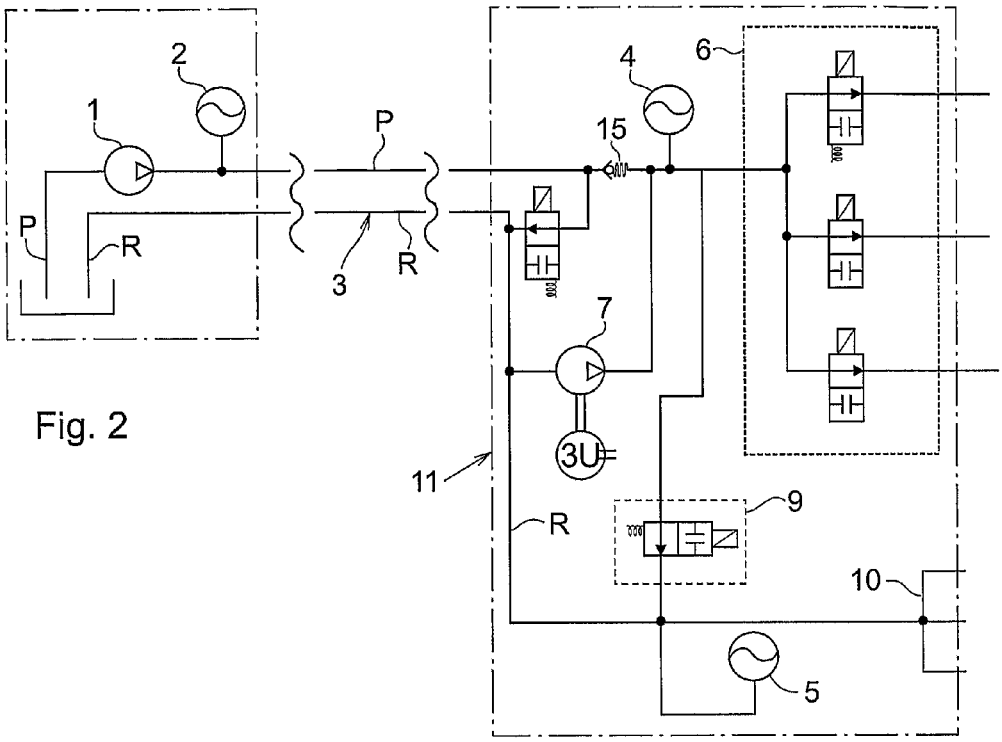
FIG. 2 is a schematic of an electro-hydraulic power system.

With reference specifically to FIG. 2, the basic components of the invention are the top-side hydraulic pump 1 driven by a standard industrial electrical motor (not shown) and an accumulator bank 2 supplying hydraulic power at typically 207 bar through the small bore supply conduit P included in the umbilical 3. A sub-sea HPU 11 located typically at a central structure at the production site comprises a canister 110 to protect components of the sub-sea HPU from the environment, a medium pressure (typically 207 bars plus environmental pressure) accumulator bank 4, a low pressure accumulator bank 5 operating at a pressure higher than the environmental pressure, a set of DCVs 6 which distribute flow of hydraulic power to end consumers at operating pressure, a manifold for collection of return fluid from end consumers 10, and a system of ESD valves 9, a booster unit 7 comprising a pump and motor to boost pressure from the return pressure to operating pressure, a DCV 8 to facilitate fluid circulation at reduced pressure, and return line R.

In normal steady state operation mode, i.e. when the natural DCV internal leakage (normally minute) is the only fluid consumption, the hydraulic power supply is provided by means of the supply line P with the sub-sea booster unit 7 in standby mode. This mode of operation is totally time dominant with at least 95% of the time, and for a typical system substantially more.

In the transient mode, i.e. operation of valves, the fluid consumption is temporarily relatively high, the fluid supply from the supply line P is insufficient and assistance from the booster 7 is required. This situation is also typical of sub-sea process plants which include fast acting production control valves (PCVs). The booster 7 is used to charge the medium pressure accumulator bank 4 from the low pressure accumulator bank 5. The booster motor is typically a squirrel cage unit running off the high voltage AC electrical power supply via a step down transformer, typically stepping the 3 phase, 5-60 Hz power down from 3-24 kV to 220 volts.

For long tieback distances it may be advantageous to transfer electrical power to the booster motor and sub-sea electronics at low frequencies, or even extreme low frequencies down to 1 Hz. In practice, a power supply of AC-voltage at about 5 Hz has proven feasible at longer distances. Although resulting in lower rotational speed and capacity that requires up-sizing of the sub-sea HPU-motors and pumps, the reduced load on equipment also extends its life span and would still be a cost-effective option at long distances where cost of equipment is a less discriminating factor than is weight, e.g. A squirrel cage motor operating on any voltage lower than 1 kV may be wound for operation in a water-based or mineral oil-based hydraulic fluid, using common insulation materials (windings have been successfully designed for up to 9 kV). It may be practical to accept an increased size stator design in order to use a cable for the stator windings, rather than a varnish-insulated wire for extra electrical robustness. Design and fabrication of such motors represent common knowledge to those familiar with this type of technology.

Controlling the sub-sea HPU 11 from standby mode to operative mode is performed by means of a pressure sensor connected to the medium pressure accumulator bank 4, the sensor reporting via the communication system that the accumulator bank pressure is falling below a preset value, such as 185 bar, e.g., as the result of actuators being moved. A command for activating the sub-sea HPU 11 with booster unit 7 is then generated from a top-side control computer, shifting the sub-sea HPU 11 from standby mode to operative mode, thus transferring the power supply from line supply via the umbilical and top-side HPU 1 only, to a combined power supply from the top-side HPU 1 and the sub-sea HPU 11.

Typically the booster unit would be based on tilting pad bearings (not shown) for long life, although with this type of intermittent operation, actual operating time for a ten year period will not be very high compared to calendar time. With 5% transient operation, the annular active operation is some 400 hours, negligible in terms of wear. For operation of fast acting PCVs the active operation time of the booster assembly would obviously be much higher.

Although the invention is perfectly applicable also in an open hydraulic system wherein used hydraulic fluid is discharged to the sea, a special case of steady state operation, referred to in the following as circulation mode, is advantageously facilitated by means of the check valve 15. In this mode the medium pressure accumulator bank 4 provides the minor fluid consumption required to compensate for the DCV leakage. This frees both supply line P and return line R for circulation of fluid, and thus also for fluid quality control.

Figure 3:
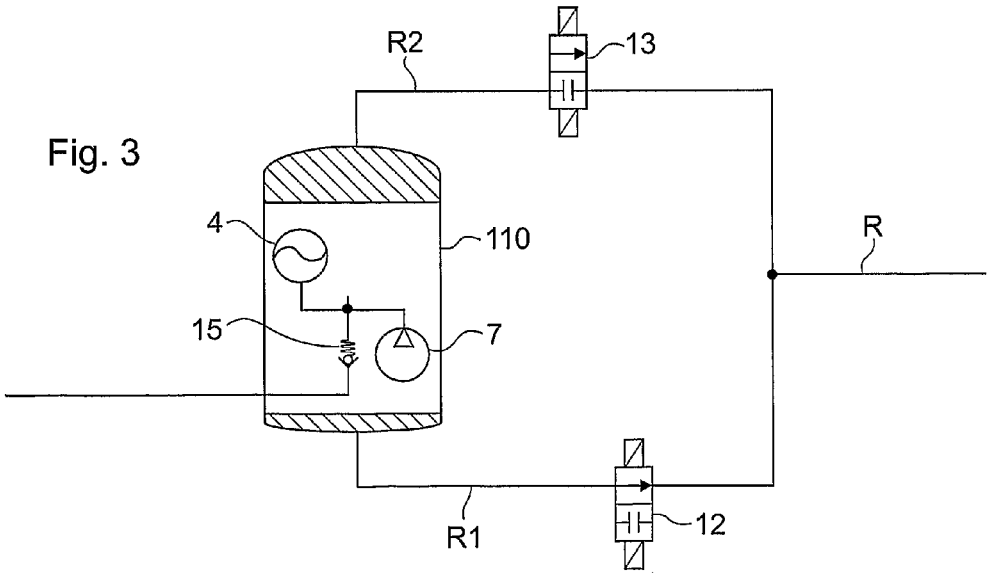
FIG. 3 is a diagrammatic illustration of the canister circuitry associated with the return side of the hydraulic system.

Whereas FIG. 2 illustrates high level features of the invention, FIG. 3 illustrates essential features related to the circulation mode that are simplified or omitted for clarity in FIG. 2. The canister 110 contains the accumulator banks 4 and 5 (5 not shown in FIG. 3) as well as the booster assembly 7, all DCVs and other components of the sub-sea HPU. The canister has typically a cylindrical section and a hemispherical cap at top and bottom. The pressure in the canister is adjusted to provide for sufficient flow return fluid and is thus to be considered a pressure vessel. ROV-operated (remotely operated vehicle) HV-connectors and hydraulic stab connectors required to provide power and fluid are standard sub-sea components used extensively in sub-sea control systems. These provide wet connections as required. The canister has the very important function of accumulating contamination, particulate contamination at the bottom and any free gas at the top. Free gas is only expected for rare cases of serious seal failures in the DHSVs. It is important to remove both types of contamination. It is also important to remove fluid that has absorbed gas although not necessarily in a free state, but enough to influence the bulk modulus in a significant way. In FIG. 3 both types of contamination are visualized by gross exaggeration for purposes of illustration, no such level of contamination is likely to ever occur. For cases where a mineral oil/synthetic oil is used as control fluid, it is also important to remove oil contaminated by ingress of water from parts of the installation, whether in free phase or dissolved in the oil.

DCVs 12 and 13 facilitate a selection of removing gas or particulate contamination by circulation. The particulate contamination is in a worst case NAS 1648 class 12, as systems of this type are invariably designed for achieving class 6, but it is common knowledge that they often operate at class 8 or even worse. Thus particles to be removed are small and travel easily in the circulation fluid.

Figure 5:
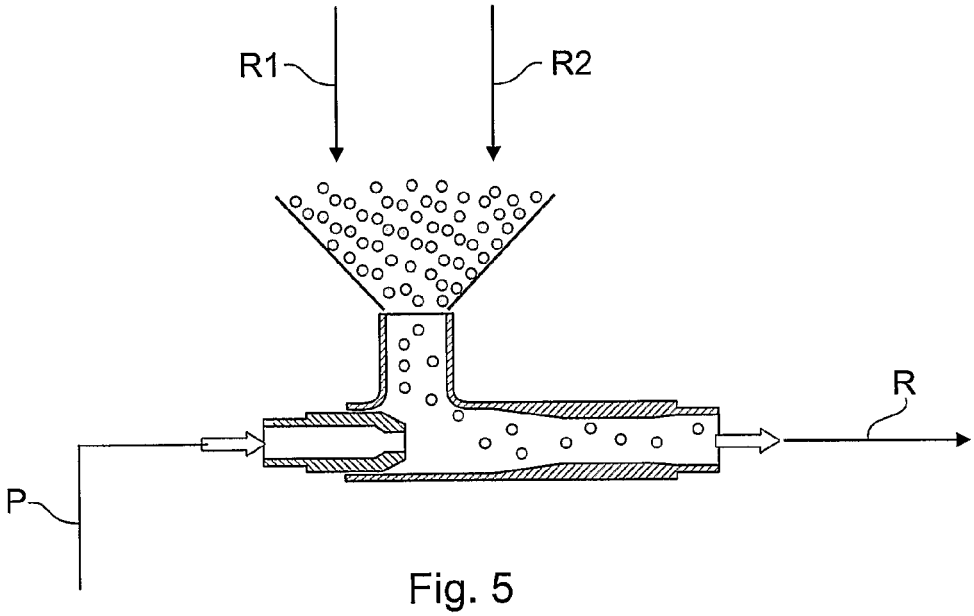
FIG. 5 illustrates a detail for enhancement of fluid circulation.

FIG. 5 illustrates in a simplified way a device for enhancement of circulation in the isolated mode without using moving parts. R1 and R2, as per selection, feed contaminated fluid into an eductor which is operated by means of the energy in the P line. The return line R pressure is enhanced and simultaneously the contaminated fluid is effectively injected into the return line R. Considerable pressure increase is available without pressurizing the canister volume. Eductors are commodity items.

Alternatively, though not shown in the drawings, a closed loop embodiment may additionally comprise a hydraulic circuit connecting the manifold from end consumers 10 to the return line R, downstream of the eductor of FIG. 5, and controlling the return flow to the top-side HPU externally of the sub-sea HPU circuits via a check valve dedicated for this purpose.

The check valve 15 is normally not permitted in design of sub-sea production control system, as the primary ESD mode is to bleed hydraulic fluid back from the sub-sea control modules, thus closing all fail-close safety valves.

For very long offset control systems this traditional ESD mode of operation will not provide sufficient ESD response, and new mechanisms are required. Thus, as ESD has to be readdressed and be based on spring charged DCVs for bleed down of fluid pressure, the check valve is considered acceptable, thus facilitating the circulation mode.

This approach raises the issue of ESD availability, normally expressed as the safety integrity level (SIL), which simply states the probability of success (in any mode of operation at any time) of achieving ESD on command. This functionality is critical and the probability of success is required to be very high.

Figure 4:
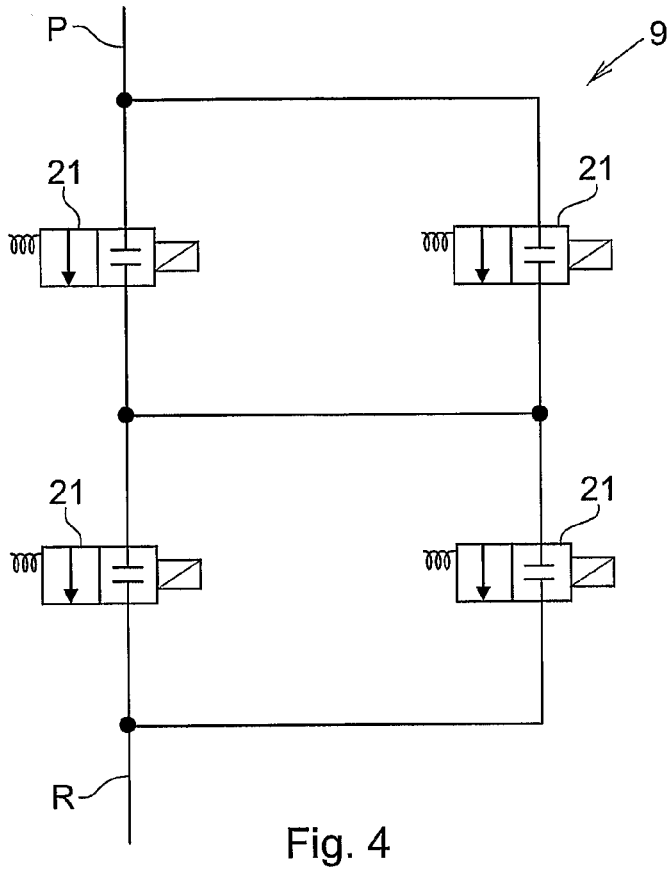
FIG. 4 is a detail of the ESD circuitry.

The ESD system 9 suggested in FIG. 4 will achieve the required functionality for ESD. Four standard DCVs 21 are connected as shown to ascertain ESD on command. No single failure of a DCV can prevent ESD and no single failure of a DCV can prevent production. The suggested type of redundancy can be expanded, but the suggested arrangement is sufficient to achieve very high SIL value.

Investigations have demonstrated that this type of circuit improves the ESD availability as compared to a single valve by a factor ranging from 10-25, depending on assumptions made for common mode failure. Improvement factor of 10 would correspond to a 5% common mode factor and an improvement factor of 25 would correspond to a common mode factor of 2%. By careful design it is possible to approach the 2% level, thus providing a very high availability of the shutdown function. Thus the traditional ESD mode, i.e. bleed down from the host end, is no longer required. Also, it is no longer feasible.

FMECA (failure mode and effect consequence analysis) and reliability analysis show that the current valve configuration (FIG. 4) has a PFD (probability of failure to perform its safety function on demand) of 1.6 E-06 (0.00015%). Consequently, the system will comply with SIL 3 requirements, which is the typical safety integrity level specified for ESD systems.

The DCVs are held open by means of dedicated electrical lines (low voltage DC) included in the umbilical. The dedicated electrical lines are wired directly to the ESD panel on the host facility.

Under normal operation, an ESD on the host facility will cut all power to the sub-sea installation. This will instantly de-energize the solenoids of the ESD valves as well as shut down all functionality of the control module. The hydraulic pressure will bleed down and shut down all production valves. For test purposes, it will be possible to cut the power to the DCV solenoids using the dedicated control lines, while maintaining the power to the control system, thus simulating an ESD under full monitoring power of the control system.

Testing of the ESD valves is an important feature. This can be achieved by supplying power to each solenoid individually or in pairs, i.e. to one DCV in each branch (FIG. 4). This configuration will enable operation of all valves in the ESD circuit, without actually initiating a shutdown of the sub-sea production system.

Proper valve functioning could be monitored by an inductive device in the DCV body, detecting the presence or absence of the DCV slide in the end position. Similarly, the same effect could be obtained by mounting a strain measurement device at the base of the DCV return spring. This will enable monitoring of the spring force, which is a function of the DCV slide position.

Testing and monitoring the operation of the ESD system 9 (see FIG. 4), is achieved by including a flow-measuring device between the accumulator bank 4 and the schematically shown ESD valve system 9 (see FIG. 2). Any flow detected in this tubing is an indication of flow through the ESD valves. As this will be a very fast acting detection system, it will be possible to open the ESD valves, detect flow and close the ESD valves 21 before a decrease in supply pressure of the hydraulic system is experienced. It is therefore possible to test the ESD system without interrupting the production.

The possibility for testing the individual valves in the ESD system 9 enables repair or replacement of an HPU with a faulty valve at convenience, thus further improving the availability of the ESD system.

Operation of DHSVs requires substantially higher pressures than the XT valves. This pressure is provided by means of standard pressure intensifiers as per now commonplace in sub-sea production control systems.

Figure 6:
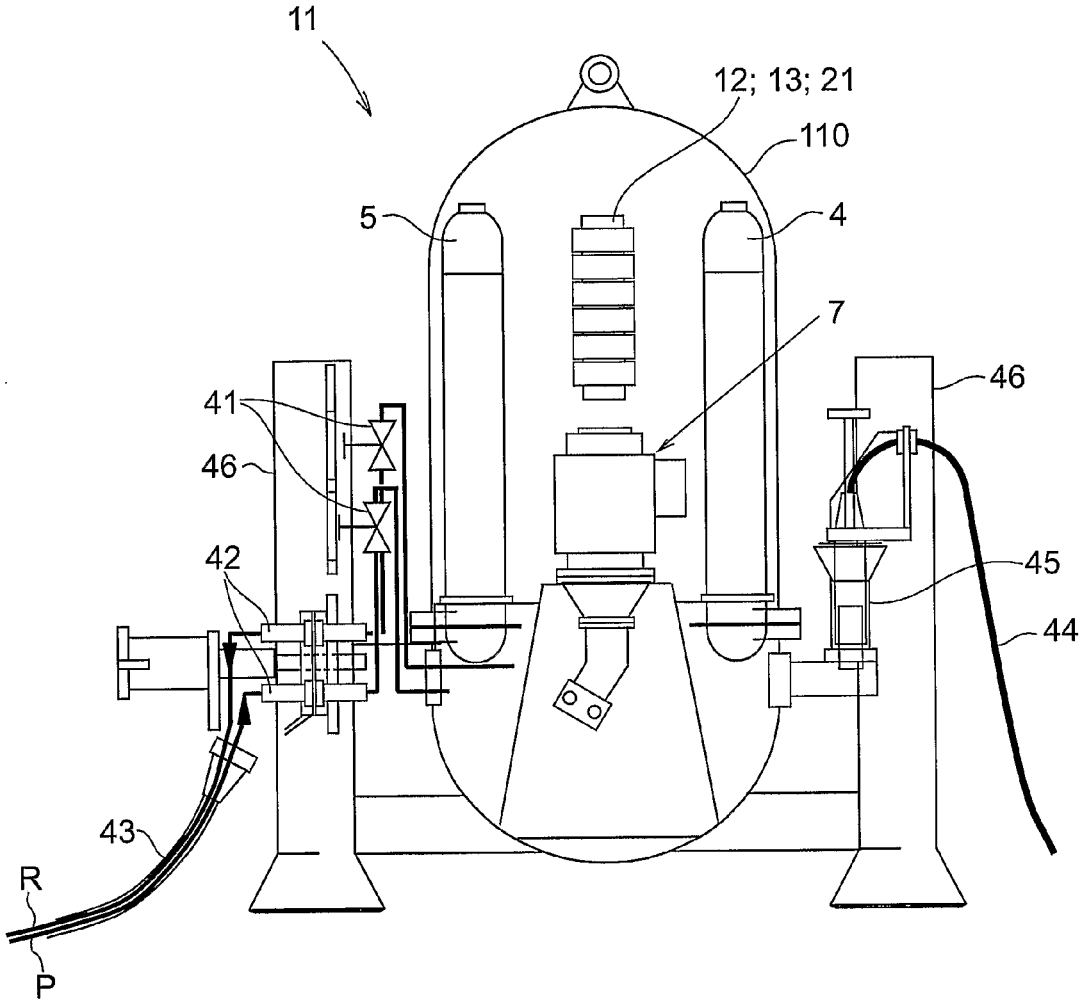
FIG. 6 is diagrammatic view of the structural layout of a sub-sea HPU embodiment according to the present invention.

The structural layout of a sub-sea HPU 11 embodiment according to the invention is schematically illustrated in FIG. 6. The canister/pressure vessel 110 is supported by a funnel support 46, resting on the sea floor. Housed in the canister 110 are the accumulator banks 4, 5, the pump and motor/transformer assembly 7, the selectively operated DCVs 12, 13 for the return flow at circulation/contamination removal mode, as well as the electrically controlled valves 21 of the ESD-system. For clarity, the internal hydraulic and electric circuits explained with reference to FIGS. 2-5 are omitted from FIG. 6. Reference number 43 designates a hydraulic jumper containing the hydraulic power supply line P and return line R, the jumper 43 connecting the sub-sea HPU 11 with an umbilical termination assembly (UTA), not shown in the layout, via ROV-operated hydraulic stab connectors 42 and the ROV-operated isolation valves 41. Likewise, reference number 44 designates an electric jumper connecting the sub-sea HPU 11 with the UTA, via the ROV-operated electric stab connector 45.

Through the structural and operational means and measures provided above, the present invention also introduces a method for operating the process control means in an electro-hydraulic process control system in a sub-sea production installation, the method comprising the steps which are apparent from the above disclosure. Modifications to the disclosed embodiment are possible while still taking advantage of the presented solution, the scope of which is defined through the appending claims.

The invention claimed is:

1. An electro-hydraulic process control system in a sub-sea production installation, comprising:

a top-side hydraulic power unit driven and controlled to generate and supply hydraulic power to a process control unit of the sub-sea production installation at a steady-state operation mode;

a sub-sea hydraulic power unit driven and controlled to generate and supply hydraulic power to the process control unit of the sub-sea production installation at a transient-state operation mode;

an umbilical comprising small bore tubing feeding hydraulic power from the top-side hydraulic power unit, and cables feeding electric power for operation of the sub-sea hydraulic power unit, and a control unit configured to control the sub-sea hydraulic power unit between a stand-by mode and an operative mode wherein the sub-sea hydraulic power unit comprises a pump driven by an electric motor, the pump being operable and controlled in the transient-state operation mode to boost a pressure of hydraulic fluid returning from the process control unit to a pressure required for operating process and safety valves of the process control unit.

2. The control system according to claim 1, further comprising:

a medium pressure accumulator bank configured to accumulate hydraulic fluid at operating pressure, and a low pressure accumulator bank configured to accumulate hydraulic fluid at return pressure, wherein the pump is operable to charge the medium pressure accumulator bank with hydraulic fluid from the low pressure accumulator bank.

3. The control system according to claim 2, further comprising:

a check valve configured to return hydraulic fluid supplied through the umbilical through the umbilical to the top-side hydraulic power unit in a fluid circulation mode, in a closed loop system, and at a pressure independent of the control system operating pressure.

4. The control system according to claim 3, further comprising:

a pressure vessel configured to contain components of the sub-sea hydraulic power unit, and selectively operable directional control valves and a first return flow line and a second return flow line configured to return hydraulic fluid in circulation mode to the top-side hydraulic power unit.

5. The control system according to claim 4, wherein the first return flow line exits the pressure vessel from a bottom region thereof, extracting hydraulic fluid and particulate matter deposited in the pressure vessel, and the second return flow line exits the pressure vessel from a top region thereof, extracting hydraulic fluid and gaseous matter eventually accumulated in the pressure vessel.

6. The control system according to claim 5, further comprising:

an eductor connected to the first return flow line and the second return flow line, wherein the eductor is powered by the hydraulic pressure supplied through the umbilical and is operative to accelerate the hydraulic fluid extracted from a bottom region and a top region of the pressure vessel, respectively.

7. The control system according to claim 1, further comprising:

a bridge circuit emergency shut down system comprising at least two sets of directional control valves connected in series, each set including at least two directional control valves connecting in parallel the supply line and the return line, wherein the directional control valves electrically powered through the umbilical and controlled into a normally closed position.

8. The control system according to claim 7, wherein the directional control valves of the emergency shut down system are controllable individually or in pairs into an open position, enabling operational test of all valves in the system without loss of production in the sub-sea production installation.

9. A method for operating a process control unit of an electro-hydraulic process control system in a sub-sea production installation, the method comprising:

feeding hydraulic power, via an umbilical, from a top-side hydraulic power unit for operating the process control unit in a steady-state operation mode of the process control system;

feeding electric power, via the umbilical, for operating a sub-sea hydraulic power unit, controlling the sub-sea hydraulic power unit between a stand-by mode and an operative mode for operating the process control unit, in a transition operation mode of the process control system, and boosting, by said sub-sea hydraulic power unit, the pressure in hydraulic fluid returning from the process control unit into a higher pressure required for operating process and safety valves of the process control system.

10. The method according to claim 9, further comprising:

separating, in a circulation mode, a flow of hydraulic fluid supplied via the umbilical from a flow of hydraulic fluid required to operate the process control unit, and returning the supplied hydraulic fluid via the umbilical in a closed loop system.

11. The method according to claim 10, further comprising:

extracting contaminants from the hydraulic fluid, at sub-sea level, in the circulation mode.

12. The method according to claim 11, further comprising:

depositing particulate contaminants at a bottom region of a pressure vessel, accumulating gaseous contaminants in a top region of said pressure vessel, and selectively extracting hydraulic fluid with particulate or gaseous contaminants from said pressure vessel.

13. The method according to claim 12, further comprising:

accelerating the return flow of hydraulic fluid by utilizing an eductor.

14. The method according to claim 9, further comprising:

providing a redundant emergency shut down system by the introduction of multiple emergency shut down valves, electrically controlled into a normally closed position and individually operable into an open position for test purposes.

15. The method according to claim 9, further comprising:

stepping down the electric power supplied via the umbilical, to a low voltage alternating current suitable for powering an electric motor and pump of the sub-sea hydraulic power unit.

* * * * *